US005294592A

United States Patent [19]

Noguchi et al.

[11] Patent Number: 5,294,592

[45] Date of Patent: Mar. 15, 1994

[54] THERMAL-TRANSFER RECORDING SHEET

[75] Inventors: Michiko Noguchi, Hachioji; Toshifumi Ishikawa, Sagamihara; Takashi Yamagishi, Yokohama, all of Japan

[73] Assignee: Teijin Limited, Osaka, Japan

[21] Appl. No.: 31,479

[22] Filed: Mar. 15, 1993

[30] Foreign Application Priority Data

Jun. 18, 1992 [JP] Japan ..... 4-159463

[51] Int. Cl.[5] ..... B41M 5/035; B41M 5/38

[52] U.S. Cl. ..... 503/227; 428/195; 428/206; 428/327; 428/480; 428/704; 428/913; 428/914

[58] Field of Search ..... 8/471; 428/195, 206, 428/327, 340, 480, 704, 913, 914; 503/227

[56] References Cited

U.S. PATENT DOCUMENTS 4,965,238 10/1990 Henzel ..... 428/913

4,965,239 10/1990 Henzel ..... 428/914

*Primary Examiner*—Pamela R. Schwartz

*Attorney, Agent, or Firm*—Sherman and Shalloway

[57] ABSTRACT

A thermal-transfer recording sheet of an aromatic polyester film, wherein at least one surface of said sheet has, as a thermal-transfer ink receiving layer, a coating of a composition comprising (1) a copolyester, (2) a polyolefin fine particle filler and (3) an antistatic compound selected from the group consisting of organic titanate and organic zirconate. The above thermal-transfer recording sheet exhibits excellent adhesion to heat-melting inks and excellent capability of receiving heat-melting ink layers and has good antistatic properties.

17 Claims, No Drawings

THERMAL-TRANSFER RECORDING SHEET

BACKGROUND OF THE INVENTION

1. Field of the Invention

The present invention relates to a thermal-transfer recording sheet. More specifically, it relates to a recording sheet which is used in a thermal-transfer recording method in which an ink is transferred to the recording sheet by heating an ink layer of a thermal-transfer donor medium with a heating means, and which enables the high-quality recording of a signal, e.g., an image signal.

2. Prior Art

In recent years, a thermal-transfer recording method has been and is employed for facsimile machines, computer terminals, barcode recorders, printers and copying machines for the following reasons. It is noiseless due to the use of no impact and maintenance-free. It does not require a high cost, it can achieve a decrease in the size and weight of equipment, and it permits the recording in colors.

The thermal-transfer recording method refers to a method in which those portions of an ink layer on a thermal-transfer donor medium surface which correspond to recording signals are heated and melted to bring those portions of the ink layer into contact with a recording sheet and transfer those portions to the recording sheet. In the heat-melting ink layer used for this thermal-transfer recording, there are used inks prepared by dispersing a variety of pigments, aids, antistatic agents and fillers in wax-base binders such as paraffin wax, oxidized paraffin wax and carnauba wax or synthetic resin-base binders such as low-melting-point polyester, polyamide, a polyacrylic acid copolymer and a polystyrene copolymer.

In recording by the above thermal-transfer method, the recording sheet is required to receive ink layers of the above inks and permit the tight adherence of the inks. In general, a specially designed sheet is therefore used as the recording sheet.

It is now been studied to record data on a transparent recording sheet with a thermal-transfer type printer and use it as the data-recorded transparent sheet in an overhead projector (OHP). It is therefore increasingly desired to develop a sheet suitable for this purpose.

In terms of transparency, heat resistance and mechanical strength, plastic films such as a polyester film, a polyamide film, a polypropylene film and a polycarbonate film are used as the above transparent recording sheet. Since, however, these plastic films show poor adhesion to the above heat-melting inks, it cannot be said that these films can adequately receive the heat-melting ink layer.

When the adhesion between a plastic film and a heat-melting ink is inadequate, a so-called white spot occurs, which is a phenomenon that those portions of an ink layer in a molten state under heat which correspond to a signal are partially not transferred to a recording sheet. In particular, a white spot is liable to occur correspondingly to an edge portion of a recording signal and a narrow line portion thereof.

Color printers using a thermal-transfer method have been being widely used in recent years. When data is recorded in colors with a color printer, at most four kinds of heat-melting inks are to be transferred to one place of a recording sheet. When the recording sheet inadequately receives these inks, the print reproducibility is poor, and this phenomenon frequently occurs when the inks having a low color density are transferred. Further, when inks having a high color density are transferred, an intended final color is not reproduced, or there occurs a so-called white spot phenomenon that a specific color is, or specific colors are, not recorded.

The recent recording density by a thermal-transfer method is as high as 300 to 400 dots per inch (dpi), and when inks are thermally transferred in a low color density, the heat energy to be applied to each dot varies finely. And, each of ink layers of cyan, yellow, magenta and black are required to be transferred faithfully to a recording sheet correspondingly to fine variations of the heat energy.

Further, when the adhesion between a recording sheet and ink(s) is inadequate, the durability of an image on the recording sheet decreases. For example, sheets obtained by thermal transfer for an overhead projector are sometimes mutually brought into contact or printed surfaces of the sheets are rubbed against each other. When the durability of the ink layer is low, the ink layer peels off the sheet, and an image is badly impaired.

When recording sheets run through a printer, the following problems frequently occur. For example, there occur an overlapped feeding problem in which a plurality of sheets are fed out at one time from a tray, a jamming problem in which a sheet does not smoothly run due to a friction when it runs through rollers in the printer, and a feed-out problem in which a printed sheet sticks to another printed sheet on a tray to push it out or pull it into the printer when the former printed sheet is present on the tray. It is generally considered that these problems are mainly caused by electrostatic charge which has generated on the sheets.

Further, when a recording sheet is electrostatically charged, the printing surface of the recording sheet adsorbs dust around it to cause a white spot.

On the other hand, a printer is usually used in various environments. In particular, when a printer is used in a low-humidity environment, a recording sheet is liable to be electrostatically charged in printing, and the electrostatic charge causes the above white spot or a failure in ink transfer.

For the above reasons, it is strongly desired to carry out good antistatic treatment on recording sheet, and a variety of methods have been and are proposed.

Naturally, however, it should be avoided to impair the transparency of a recording sheet and the adhesion between a recording sheet and inks due to the antistatic treatment.

SUMMARY OF THE INVENTION

It is an object of the present invention to provide a thermal-transfer recording sheet.

It is another object of the present invention to provide a thermal-transfer recording sheet which shows excellent adhesion to heat-melting inks and excellent capability of receiving heat-melting ink layers.

It is further another object of the present invention to provide a thermal-transfer recording sheet which permits printing in intended color(s) with good reproducibility and is substantially free from causing white spots when the recording is made in color(s) with a color printer using a thermal-transfer method.

It is still further another object of the present invention to provide a thermal-transfer recording sheet having antistatic properties.

According to the present invention, the above objects and advantages of the present invention are achieved by a thermal-transfer recording sheet of an aromatic polyester film, wherein at least one surface of said sheet has, as a thermal-transfer ink receiving layer, a coating of a composition comprising (1) a copolyester, (2) a polyolefin fine-particle filler and (3) an antistatic compound selected from the group consisting of organic titanate and organic zirconate.

In a preferred embodiment of the present invention, the antistatic compound is selected, as the organic titanate and organic zirconate, from the class consisting of a compound of the formula (1), $$R^1—O—Me—(O—X)_3 \quad (1)$$

wherein $R^1$ is a monovalent aliphatic hydrocarbon having 1 to 20 carbon atoms, which may be optionally interrupted by an oxygen atom, Me is Ti or Zr, and X is a group selected from a class consisting of $—SO_2R$, —COR and

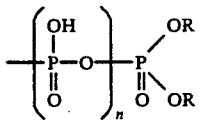

in which R is a group selected from the class consisting of an alkyl group having 1 to 20 carbon atoms, an alkenyl group having 1 to 20 carbon atoms, an alkylphenyl group having 7 to 20 carbon atoms, and an amino-substituted phenyl group and n is 0 or 1, provided that a plurality of Rs (3 or 6 Rs) in the above definition of X may be the same or different from one another, and an adduct of the above compound of the formula (1) with a (meth)acrylamide derivative in which an aminoalkyl group having 1 to 20 carbon atoms bonds to a nitrogen atom of (meth)acrylamide.

In another preferred embodiment of the present invention, the antistatic compound is formed of a combination of a compound selected from the class consisting of the compound of the formula (1) and the above adduct of the compound of formula (1) with the (meth)acrylamide derivative, with a compound of the formula (2),

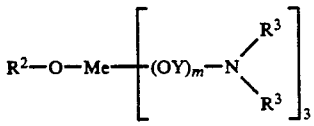

(2)

wherein $R^2$ is a monovalent aliphatic hydrocarbon having 1 to 20 carbon atoms, which may be optionally interrupted by an oxygen atom, Me is Ti or Zr, Y is an alkylene group having 2 to 4 carbon atoms, $R^3$ is a lower alkyl group having 1 to 5 carbon atoms, and m is 1 to 10, provided that six $R^3$s in the formula may be the same or different from one another.

DETAILED DESCRIPTION OF THE INVENTION

The copolyester (1) which is one component of the coating used as a thermal-transfer ink receiving layer refers to a copolyester (type A) formed from at least two dicarboxylic acid components and at least one diol component, or a copolyester (type B) formed from at least one dicarboxylic acid component and at least two diol components.

The above copolyester (1) is preferably linear or substantially linear. The number average molecular weight of the copolyester (1) is 5,000 to 50,000, preferably 7,000 to 30,000. The glass transition temperature of the copolyester (1) is at least 0° C., preferably 10° to 100° C.

The above dicarboxylic acid component to form the copolymer (1) may be either of an aromatic dicarboxylic acid component and an aliphatic dicarboxylic acid component. For improving the heat resistance of the copolyester, preferred is a dicarboxylic acid component composed mainly of an aromatic dicarboxylic acid, and particularly preferred is a dicarboxylic acid component containing at least 60 mol % of an aromatic dicarboxylic acid.

Specific examples of the aromatic dicarboxylic acids include terephthalic acid, isophthalic acid, 2,6-naphthalenedicarboxylic acid and 4,4'-diphenyletherdicarboxylic acid. Examples of the aliphatic dicarboxylic acids preferably include adipic acid and sebacic acid.

The diol component can be preferably selected from aliphatic diols, polyalkylene ether glycols and aromatic diols.

Specific examples of the aliphatic diols include ethylene glycol, tetramethylene glycol, neopentyl glycol and diethylene glycol. Specific examples of the polyalkylene ether glycols include polyethylene ether glycol and polytetramethylene glycol. Specific examples of the aromatic diols include hydroquinone, resorcin, bis(4-hydroxyphenyl)sulfone [bisphenol S], 2,2-bis(4-hydroxyphenyl)propane [bisphenol A] and alkylene oxide addition products (adducts) of these such as 2,2-bis(4-hydroxyethoxyphenyl)propane and 2,2-bis(4-hydroxypropoxyphenyl)propane.

The above copolyester (1) of type A contains at least two dicarboxylic acid components, and it preferably contains at least two aromatic dicarboxylic acid components. The copolyester (1) of type A contains at least 60 mol % of at least two aromatic dicarboxylic acids selected from the above aromatic dicarboxylic acids. Further, any one of the at least two dicarboxylic acid components constituting the copolyester (1) of type A is contained preferably not more than 90 mol %, particularly preferably not more than 80 mol %, based on the total content of the dicarboxylic acid components.

The copolyester (1) of type B contains at least two diol components, and these diol components are preferably selected from the above aliphatic diols, polyalkylene ether glycols and aromatic diols. The content of these diol components is preferably at least 60 mol % based on the total content of the diol components. Further any one of the at least two diol components constituting the copolyester (1) of type B is contained preferably not more than 90 mol %, particularly preferably not more than 80 mol %, based on the total content of the diol components.

The above copolyester (1) can be easily produced by any of methods known per se, i.e., a method in which dicarboxylic acid(s) and diol(s) are directly esterified, and a method in which ester derivative(s) of dicarboxylic acid(s) and diols are subjected to an ester-exchange reaction.

The copolyester (1) preferably contains a sulfonic acid group or a salt thereof, particularly preferably contains a salt of a sulfonic acid group. The content of the sulfonic acid group or a salt thereof is preferably 0.5 to 10 mol %, particularly preferably 1 to 5 mol %, based on the dicarboxylic acid component. When the copolyester (1) has a sulfonic acid group or a salt thereof, the copolyester (1) shows improved dispersibility or solubility in water and improved affinity to the polyolefin fine particle filler. As a result, a coating liquid for forming a coating can be easily prepared.

The salt of a sulfonic acid group preferably includes sodium salt, potassium salt, magnesium salt, calcium salt and ammonium salt. Sodium salt is particularly preferred.

The sulfonic acid group or salt thereof can be introduced to the copolyester (1) by a method known per se. For example, a predetermined amount of dicarboxylic acid or an ester derivative thereof containing sodium salt, potassium salt or the like of the sulfonic acid group is copolymerized to produce the copolyester (1).

The above copolyester (1) preferably contains not more than 50 mgKOH/g, as a hydroxyl value, of unreacted hydroxyl groups, it further preferably contains not more than 20 mgKOH/g thereof. The coating can be imparted with water resistance when these hydroxyl groups react, for example, with an isocyanate type crosslinking agent such as "Elastron H-38" supplied by Dai-ichi Kogyo Seiyaku Co., Ltd. The amount of the isocyanate type crosslinking agent per 100 parts by weight of the copolyester (1) is 1 to 15 parts by weight.

The above-described copolyester (1) is commercially available, for example, as copolyesters of polyester WR series (supplied by Nippon Synthetic Chemical Industry Co., Ltd.), copolyesters of Plus-coat Z-450 series (supplied by Goo Chemical Co., Ltd.), copolyesters of Pesresin series (supplied by Takamatsu Oil & Fats Co., Ltd), copolyesters of Finetex series (supplied by Dainippon Ink & Chemicals. Inc.) and Eastman AQ polymers (Eastman Chemicals Co., Ltd).

The polyolefin fine-particle filler (2) used as a coating-forming component in the present invention preferably has an average particle size of not more than 20 μm, more preferably not more than 10 μm. It can be generally available as a dispersion in water. Examples of the polyolefin include (i) (co)polymers of 1-olefins such as ethylene, propylene, 1-butene and 1-pentene; (ii) copolymers of 1-olefins and vinyl acetate or complete or partial saponification products of these and copolymers of 1-olefins and dienes; and (iii) (co)polymers obtained by introducing a carboxyl group, or its ester, amide, imide or salt into any one of the above (i) and (ii) polymers.

Specific examples of the polyolefin include low-molecular-weight polyethylene, polypropylene, poly-1-butene, an ethylene-propylene copolymer, an ethylene-butene copolymer, an ethylene-propylene-butadiene copolymer, an ethylene-propylene-ethylidenenorbornene copolymer, an ethylene-propylene-dicyclopentadiene copolymer, an ethylene-vinyl acetate copolymer, and polyolefins obtained by introducing a carboxyl group or its salt of metal such as sodium, potassium, magnesium, calcium, strontium or barium into the above (co)polymers. Preferred are polyolefins having a carboxyl group and/or its salt.

When a coating liquid is prepared, it is preferred to use the polyolefin fine-particle filler (2) as an emulsion prepared by dispersing it in water. The emulsion preferably has a polyolefin concentration of about 27 to 35%, and a viscosity, measured with a Brook-Field type viscometer at a roter revolution of 6 to 60 r.p.m. at room temperature, of 10 to 1,000 cps.

The emulsion of the polyolefin fine-particle filler having an intended particle size can be prepared by a method in which the polyolefin is dissolved in an organic solvent not forming azeotrope with water, the resultant solution is uniformly mixed with water and the organic solvent is removed by evaporation or distillation, or by a method in which the polyolefin is melted and the molten polyolefin is gradually poured into hot water with stirring to form a dispersion. In these methods, for stabilizing the dispersion in water, a surfactant may be added such as a low-molecular-weight surfactant, a high-molecular-weight surfactant or a water-soluble polymer.

The antistatic compound (3) used in the present invention is selected from the class consisting of organic titanate compounds and organic zirconate compounds.

The antistatic compound (3) is preferably selected from organic titanate and organic zirconate of the following formula (1), and an adduct of the above compound of the formula (1) with a (meth)acrylamide derivative in which an aminoalkyl group having 1 to 20 carbon atoms, preferably 3 to 19 carbon atoms, bonds to a nitrogen atom of (meth)acrylamide.

$$R^1—O—Me—(O—X)_3 \quad (1)$$

wherein $R^1$ is a monovalent aliphatic hydrocarbon having 1 to 20 carbon atoms, preferably 3 to 19 carbon atoms, which may be optionally interrupted by an oxygen atom, Me is Ti or Zi, and X is a group selected from a class consisting of $—SO_2R$, —COR and

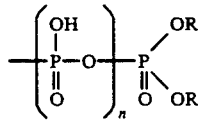

in which R is a group selected from the class consisting of an alkyl group having 1 to 20 carbon atoms, an alkenyl group having 1 to 20 carbon atoms, an alkylphenyl group having 7 to 20 carbon atoms, and an amino-substituted phenyl group and n is 0 or 1, provided that a plurality of Rs (3 or 6 Rs) in the above definition of X may be the same or different from one another.

In the formula (1), specific examples of $R^1$ include propyl, isopropyl, butyl, s-butyl, t-butyl, octyl, hexyl, nonyl, decyl, dodecyl, neopentyl (diallyl), a group of $R^4—(O—C_2H_4)_p—$ in which p is an integer of 1 to 20 and $R^4$ is an alkyl group having 1 to 20 carbon atoms, a group of $R^5—[O—CH_2CH(CH_3)]_q—$ in which q is an integer of 1 to 10 and $R^5$ is an alkyl group having 1 to 20 carbon atoms and a group of the formula

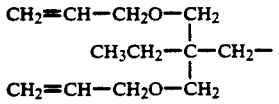

In the formula (1), the number of Rs of the group X is three when X is $—SO_2R$ or —COR, and six when

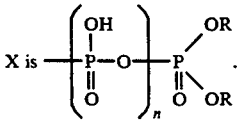

As described here, the organic titanate or zirconate has a plurality of Rs, and these Rs may be the same or different from one another.

Specific examples of Rs preferably include an alkyl group such as propyl, butyl, octyl, decyl, dodecyl and stearyl, an alkenyl group such as propenyl, an alkylphenyl group such as dodecylphenyl, nonylphenyl, octylphenyl, methylphenyl and dimethylphenyl and an amino-substituted phenyl group such as aminophenyl, N-methylaminophenyl and N,N-dimethylphenylamino.

The (meth)acrylamide derivative to form an adduct with the monoalkoxytitanate or monoalkoxyzirconate of the formula (1) preferably has the following formula,

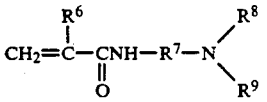

wherein $R^6$ is a methyl group or a hydrogen atom, $R^7$ is an alkylene group having 1 to 10 carbon atoms, and each of $R^8$ and $R^9$ is independently a hydrogen atom or an alkyl group having 1 to 10 carbon atoms, provided that the total number of carbon atoms of $R^7$, $R^8$ and $R^9$ is 1 to 20.

Specific examples of the (meth)acrylamide derivative preferably include

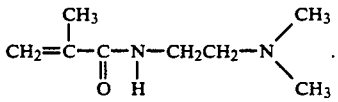

Preferred examples of the antistatic compound (3) used in the present invention are specifically as follows.

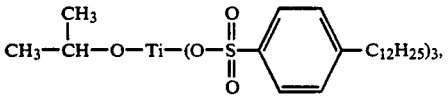

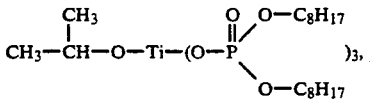

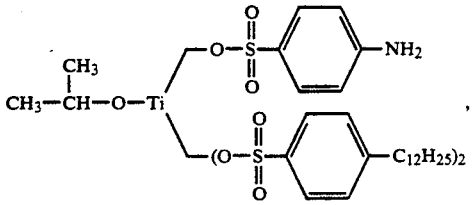

-continued

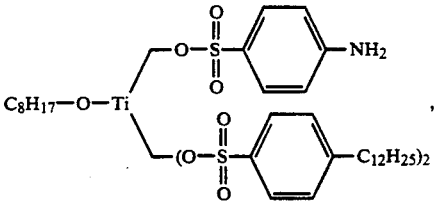

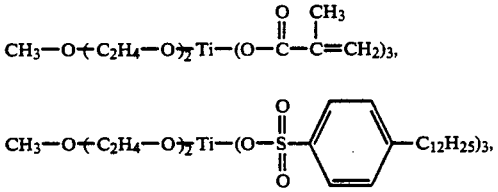

Adduct of

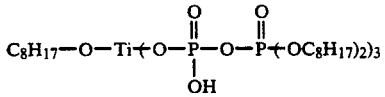

and

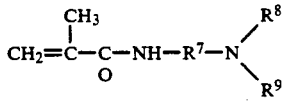

($R^7$, $R^8$ and $R^9$ are as defined above),

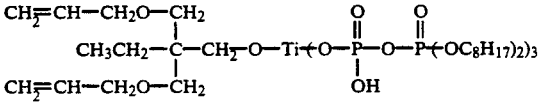

and

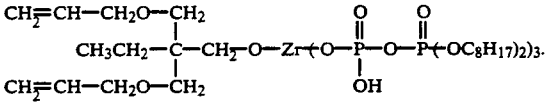

In another preferred embodiment of the present invention, the antistatic compound (3) used in the present invention is a combination of a compound selected from the class consisting of the organic titanate of the formula (1), the organic zirconate of the formula (1) and the adduct of any one of these compounds with the (meth)acrylamide derivative, with a compound of the formula (2).

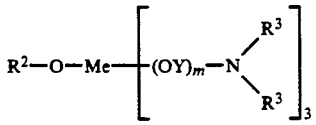

(2)

wherein $R^2$ is a monovalent aliphatic hydrocarbon having 1 to 20 carbon atoms, which may be optionally interrupted by an oxygen atom, Me is Ti or Zr, Y is an alkylene group having 2 to 4 carbon atoms, $R^3$ is a lower alkyl group having 1 to 5 carbon atoms, and m is 1 to 10, provided that six $R^3$s in the formula may be the same or different from one another.

The description of $R^1$ in the formula (1) is directly applicable to $R^2$, and preferred embodiments of the $R^1$ are also applicable to $R^2$.

Specific examples of Y in the formula (2) preferably include ethylene, propylene, trimethylene and tetramethylene.

Specific examples of $R^3$ in the formula (2) preferably include methyl, ethyl, propyl, i-propyl, butyl, s-butyl and t-butyl.

Specific examples of the compound of the formula (2) are as follows.

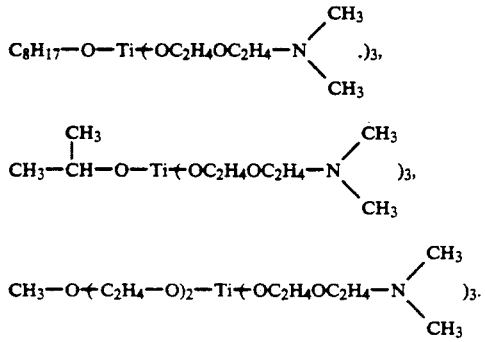

The amount of the compound of the formula (2) is preferably 10 to 90 mol %, particularly preferably 30 to 70 mol %, based on the total mols of the combination of a compound selected from the class consisting of the organic titanate of the formula (1), the organic zirconate of the formula (1) and/or the adduct of any one of these compounds with the (meth)acrylamide derivative, with a compound of the formula (2).

For achieving the objects of the present invention more desirably, the amounts of the above components in the composition to form a coating as the thermal-transfer ink receiving layer are as follows. The amount of the polyolefin fine-particle filler (2) per part by weight of the copolyester (1) is preferably 0.17 to 6 parts by weight, particularly preferably 0.5 to 4.0 parts by weight. The amount of the antistatic compound (3) per part by weight of the copolyester (1) is 0.17 to 4 parts by weight, particularly preferably 0.3 to 2.0 parts by weight.

The above composition may contain additives such as an ultraviolet absorber, a fluorescent, a sticking preventer, a wax, a filler, a surface tension adjuster and a dye.

In the present invention, a coating liquid can be prepared by any method. For example, a coating liquid can be prepared by mixing predetermined amounts of a dispersion or solution of the copolyester (1) in water, a dispersion of the polyolefin fine-particle filler (2) in water and a dispersion or solution of the antistatic compound (3) in water. The solid concentration in the coating liquid is preferably 0.5 to 10% by weight, more preferably 1 to 5% by weight.

The polyester film used in the present invention is preferably a stretched film of an aromatic polyester in view of transparency and heat resistance. In particular, a stretched film of an aromatic polyester, e.g., polyethylene terephthalate, polybutylene terephthalate or polyethylene-2,6-naphthalenedicarboxylate is preferred, since excellent resolution at an order of 10 μm and a high image density can be achieved and since a substrate sheet does not undergo deformation under heat for forming an image.

The stretched film of aromatic polyester can be obtained, for example, by a method in which said aromatic polyester is melted and formed into an unstretched film, and then the unstretched film is further biaxially oriented and set at a high temperature.

A polyester film containing no lubricant is preferred in view of transparency and surface smoothness. In view of lubricity and processability of a film, however, there may be used a film containing inorganic fine particles of calcium carbonate, kaolin, silica or titanium oxide and/or precipitated fine particles of a catalyst residue. Further, there may be used a film containing other additives such as a color adjuster. The thickness of the film is preferably 25 to 125 μm.

The coating liquid can be applied onto the polyester film by any means using a blade coater, a roll coater, a bar coater, a gravure coater, a reverse roll coater or a squeeze coater. The coating amount is preferably 0.01 to 0.5 g/m$^2$ (as a solid content or dry weight). The applied coating liquid is dried to give a coating as an ink receiving layer. The thickness of the coating is generally approximately 0.01 to 0.5 μm.

The surface tension of the above coating is preferably at least 48 dyne/cm$^2$. In this case, tone reproduction can be achieved in full-color printing, and reproduction of a human skin color can be achieved for example.

The surface tension of the coating as an ink receiving layer can be adjusted to at least 48 dyne/cm$^2$, for example, by corona treatment, electron beam irradiation, ultraviolet light irradiation, plasma treatment or ozone oxidation treatment. Of these treatments, corona treatment and electron beam irradiation are preferred, since they are simply carried out and the conditions can be easily optimized. For example, in the corona treatment, it is preferred to adjust the surface tension by optimizing the charged voltage, current and treatment atmosphere, and more specifically, it is preferred to carry out the corona treatment at a charged current of 10 A under nitrogen atmosphere as standard conditions.

The recording sheet of the present invention has a constitution in which at least one surface of the polyester film has, formed thereon, a coating (an ink receiving layer) of a composition comprising the copolyester (1), the polyolefin fine particle filler (2) and the antistatic compound (3). When the above coating is formed on one surface of the polyester film, it is preferred to form a protection film containing an antistatic agent on the opposite (reverse) surface of said film for imparting the film with functions such as running properties, antistatic properties and stain resistance. In this case, the protection layer is preferably not to be transferred to, or migrated into, the ink receiving layer.

Although not specially limited, the above protection layer is preferably formed, e.g., of a composition obtained by incorporating an inorganic filler such as silica, alumina, talc, kaolin or titanium oxide and/or an organic filler such as polystyrene, polyolefin, benzoguanamine, urea or silicone, and a cationic antistatic agent, a nonionic antistatic agent, anionic antistatic agent, an electrically conductive filler and/or the same compound as the above antistatic compound (3) into a binder such as copolyester, polystyrene, polyacrylic acid ester, polyurethane, a vinyl chloride-vinyl acetate copolymer or a phenoxy resin.

The thickness of the protection layer is preferably 0.01 to 5.0 μm, more preferably 0.02 to 1.0 μm. The protection layer can be formed by uniformly coating the above composition and drying it according to any conventional method.

The recording sheet of the present invention, obtained as described above, is useful for print-recording with a thermal-transfer printer, and exhibits excellent printing properties under wide environmental conditions. This recording sheet reproduces a high-quality image and has excellent adhesion to a heat-melting ink. The image can endure storage for a long period of time.

Further, the recording sheet of the present invention has a characteristic feature that it is excellent in running properties when it is fed-in and out and when recording is made. Moreover, the recording sheet of the present invention exhibits excellent antistatic properties, and printed sheets are free of disorder when continuous printing is made. Further, when a plurality of the printed sheets are set together by pitching them, one sheet does not stick to another, or the printed sheets show excellent handling properties.

The present invention will be explained hereinafter by reference to Examples, in which "part" stands for "part by weight".

Recording sheets obtained in Examples were evaluated on their properties as follows.

1) Surface specific resistance

Aluminum was vapor-deposited on a film sample having a size of 8 cm×8 cm, and the sample was measured for a surface specific resistance (Ω/□) under the conditions of 23° C. and 60% RH with a high-voltage electric source resister and a vibrating reed electrometer TR-84M supplied by Takeda Riken Kogyo Co., Ltd).

2) Surface lubricity

Coated surfaces were measured for static friction coefficient between them at 23° C. and 60% RH under a load of 1 kg with a slippery measuring tester supplied by Toyo Tester Co., Ltd.

3) Blocking tendency

Coated surfaces of a sample film were attached to each other, and then cut to a size of 10 cm×5 cm. The so-cut sample was placed in an atmosphere of 60° C. and 80% RH under a load of 6 kg/cm$^2$ for 17 hours, and then measured for a peel strength by peeling it into two portions having a width of 5 cm at a peel rate of 100 mm/minute. ○ stands for a peel strength of not more than 10 g/cm and X stands for more than 10 g/cm.

4) Transparency (haze)

A film sample was measured for a haze according to JIS-K-6714 with a haze meter of an integrating sphere method (Digital Haze meter, supplied by Nippon Denshoku Kogyo K.K.).

5) Printing properties

A sheet prepared for thermal-transfer recording was cut to sheets having an A-4 size, and a tone-reproduction pattern and a resolution-evaluation pattern were printed thereon with a thermal-transfer printer (CHC-443, supplied by Shinko Electric Co., Ltd.). The printed sheets were evaluated as follows.

(1) Tone

Sheet samples on which the tone-reproduction pattern had been printed was measured for tone reproducibility with a Macbeth densitometer (TR-924) to determine 16 gradations. Sheet samples showing a smooth change in density on the basis of the gradation curve were regarded as excellent (○), and sheet samples showing a sharp change in density somewhere in the gradation were regarded as poor (X).

(2) Image density

The maximum density in the printed tone-reproduction pattern was regarded as an image density.

(3) Resolution

A recording sheet on which a resolution-evaluation pattern had been printed was observed through a microscope at a magnification of 100 diameters, and an image of lines and image of characters were examined on their decipherability. A sheet having an image whose narrow lines were clearly distinct and not discontinued was regarded as excellent resolution (○), and a sheet having an image whose narrow lines were fogged or overlapped was regarded as poor (X).

6) Continuous feed-in and feed-out properties

Thirty recording sheets were placed in a paper feed tray, and a standard pattern was continuously printed. A case when the thirty recording sheets were continuously fed out without causing any overlapping paper feed and any jamming in a machine was regarded as excellent paper feed in and out (○), and a case when some trouble occurred in paper feeding or paper running was regarded as poor (X).

7) Adhesion of ink

The printing was carried out in the same manner as in the above 6), and 10th, 20th and 30th sheets were used as samples. A cellophane tape (supplied by Nichiban Company Limited) was attached to an ink printed on each sheet, and a roller weighing 2 kg was moved thereon forward and backward once. Then, the tape was forcibly peeled off. Sheets from which even a slightest amount of the ink was removed were regarded as poor (X), and sheets on which the ink remained intact were taken as excellent (○).

EXAMPLE 1

Preparation of a coating liquid for ink receiving layer (a) 16.0 Parts of a copolyester formed from a small amount of sodium sulfoisophthalic acid

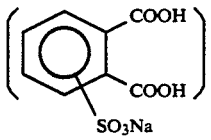

as a dicarboxylic acid component and having a softening point of 120° C., a glass transition temperature (Tg) of 70° C., a Shore hardness (D scale) of 85, a resin sheet breaking strength of 550 kg/cm$^2$ and a number average molecular weight of 15,000, (b) 18.1 parts of a copolyester formed from a small amount of sodium sulfoisophthalic acid and having the same properties as those of the above copolyester (a) except that the Tg was 20° C., (c) 24.0 parts (as a solid content) of a water-dispersion of polyethylene ionomer having an average particle size of 0.1 μm or less and a softening point of 59° C. (trade name: Chemipearl S-120, supplied by Mitsui Petrochemical Industries, Ltd), (d) 21.9 parts (as a solid content) of a water-dispersion of polyethylene ionomer having an average particle size of 0.5 μm and a softening point of 67° C. (trade name: Chemipearl S-300, supplied by Mitsui Petrochemical Industries, Ltd) and (e) 20.0 parts of an antistatic agent formed of a mixture of the compounds of the following formulae $A_1$ and $B_1$ ($A_1$:$B_1$=40:60 (molar ratio)) were dissolved and dispersed in an isopropyl alcohol/water mixed solvent (weight ratio=80/20) to prepare a coating liquid having a solid content of 1.64% by weight.

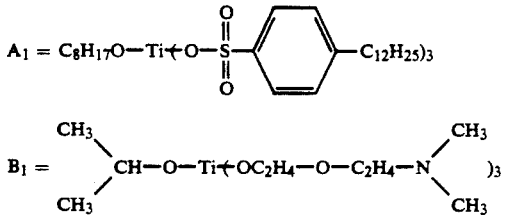

Preparation of coating liquid for protection layer (f) 5.6 Parts of an antistatic agent (solid content 10%) of oleylimidazoline dibutylphosphate/polyethylene oxide (10) octyl phenol ether (weight ratio=70/30) was dissolved in 394.4 parts of a water/isopropyl alcohol mixed solvent (weight ratio=20/80) to prepare a coating liquid having a solid content of 0.14% by weight.

Preparation of recording sheet

The above coating liquid for an ink receiving layer was applied to one surface of a 75 μm thick polyethylene terephthalate film with a 180-line/inch microgravure roll to form a coating having a weight of 6 g/m$^2$ (wet), and the coating was dried by passing the film through a hot-air dryer at 100° C. for 40 seconds to form an ink receiving layer.

Then, the above coating liquid for a protection layer was applied to the reverse surface of the above polyethylene terephthalate film with a 180-line/inch microgravure roll, and the resultant coating was dried by passing the film through a hot-air dryer at 80° C. for 40 seconds to form a protection layer.

The above ink receiving layer was corona-treated with a corona-treating apparatus (supplied by Eny K.K.), at a rate of 50 m/minute at a charged current of 10 A under a nitrogen atmosphere. The so-treated ink receiving layer showed a surface tension of 55 dyne/cm$^2$.

The above-obtained film was cut to obtain recording sheets having an A-4 size. The recording sheets were evaluated on their printing properties. Table 1 shows the results.

EXAMPLE 2

Recording sheets were prepared in the same manner as in Example 1 except that the amount of (d) a dispersion of polyethylene ionomer in water was changed to 13.5 parts (as a solid content) and that 8.4 parts (as a solid content) of (g) a water-dispersion of a low-molecular-weight polyethylene (trade name: Chemipearl W-308, supplied by Mitsui Petrochemical Industries, Ltd) having a particle size of 7.0 μm and a softening point, measured by a ring and ball method, of 132° C. was additionally used. The recording sheets were evaluated on their printing properties, and Table 1 shows the results.

EXAMPLE 3

Recording sheets were prepared in the same manner as in Example 2 except that the (e) antistatic agent was replaced with 20.0 parts of a mixture of the compounds of the following formulae $A_2$ and $B_2$ ($A_2$:$B_2$=50:50 molar ratio). The recording sheets were evaluated on their printing properties, and Table 1 shows the results.

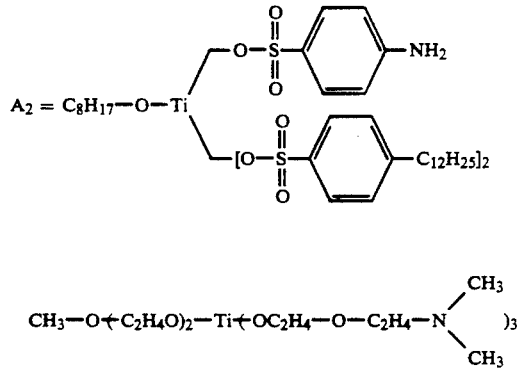

EXAMPLE 4

Recording sheets were prepared in the same manner as in Example 1 except that the (c) water-dispersion of polyethylene ionomer and the (d) water-dispersion of polyethylene ionomer were replaced with 41.7 parts of (i) polyethylene ionomer having an average particle size of 0.1 μm and a Vicat softening point of 60° C. (trade name: Zaikthene, supplied by Sumitomo Seika Chemical Co., Ltd) and 3.2 parts (as a solid content) of (g) a water-dispersion of a low-molecular-weight polyethylene (trade name: Chemipearl W-308, supplied by Mitsui Petrochemical Industries, Ltd) having an average particle size of 7.0 μm and a softening point, measured by a ring and ball method, of 132° C. The recording sheets were evaluated on their printing properties, and Table 1 shows the results.

EXAMPLE 5

Preparation of coating liquid for protection layer 83.3 Parts of (j) a copolyester (trade name: Vylon 290, supplied by Toyobo Co., Ltd.) having a bisphenol A skeleton in the main chain and having a glass transition temperature of 79° C., 8.0 parts of (k) a silicone filler having an average particle size of 0.8 μm, 2.1 parts of (l) an isocyanate compound (trade name: Colonate L, supplied by Nippon Polyurethane Industry Co., Ltd), and 6.6 parts of (m) an antistatic agent of laurylmonomethylhydroxyethylammonium nitrate were dissolved in a toluene/anone/methyl ethyl ketone mixed solvent (weight ratio=40/10/50) to prepare a coating liquid having a solid content of 1.85% by weight.

Preparation of recording sheet

Recording sheets were prepared in the same manner as in Example 2 except that the coating liquid for a protection layer was replaced with the above-prepared coating liquid. The recording sheets were evaluated on their printing properties, and Table 1 shows the results.

COMPARATIVE EXAMPLE 1

Recording sheets were prepared in the same manner as in Example 1 except that the (e) antistatic agent was replaced with an antistatic agent containing oleylimidazoline ethosulfate having a cation conversion rate of 72%, polyoxyethylene octylphenyl ether having an HLB of 8 and sodium propionate in a ratio (an effective component ratio) of 66:27:7.

As shown in Table 1, the above-obtained recording sheets were poor in color reproducibility in a low-density area and poor in color tone.

COMPARATIVE EXAMPLE 2

A coating liquid for an ink receiving layer was prepared in the same manner as in Example 1 except that the (e) antistatic agent was not used. Then, recording sheets were prepared in the same manner as in Example 1 except that the coating liquid for an ink receiving layer was replaced with the above-prepared coating liquid. As shown in Table 1, these recording sheets caused troubles of overlapped feeding when fed for printing and mutual sticking due to electrostatic charge when fed out.

COMPARATIVE EXAMPLE 3

A coating liquid for an ink receiving layer was prepared in the same manner as in Example 2 except that the (a) and (b) copolyesters were not used. Then, recording sheets were prepared in the same manner as in Example 1 except that the coating liquid for an ink receiving layer was replaced with the above-prepared coating liquid. As shown in Table 1, these recording sheets were poor in print reproducibility of narrow lines and poor in adhesion to a printing ink.

COMPARATIVE EXAMPLE 4

A coating liquid for an ink receiving layer was prepared in the same manner as in Example 2 except that the (c) and (d) polyolefin fillers were not used. Then, recording sheets were prepared in the same manner as in Example 2 except that the coating liquid for an ink receiving layer was replaced with the above-prepared coating liquid. As shown in Table 1, these recording sheets showed overlapped feeding in printing, and caused sheet jamming in a printer.

TABLE 2-continued

| | Copolyester | |
|---|---|---|
| | (a) | (b) |
| (mol %) | 70% 2,2-Bis(4-hydroxy-propoxyphenyl) propane 30% | 70% Diethylene glycol 30% |

What is claimed is:

1. A thermal-transfer recording sheet of an aromatic polyester film, wherein at least one surface of said sheet has, as a thermal-transfer ink receiving layer, a coating of a composition comprising (1) a copolyester, (2) a polyolefin fine particle filler and (3) at antistatic compound selected from the group consisting of organic titanate and organic zirconate.

2. The thermal-transfer recording sheet of claim 1, wherein the antistatic compound (3) is selected from the group consisting of (a) a compound of the formula (1)

$$R^1-O-Me(-O-X)_3 \quad (1)$$

wherein $R^1$ is a monovalent aliphatic hydrocarbon having 1 to 20 carbon atoms, which may be optionally interrupted by an oxygen atom, Me is Ti or Zr, and X is selected from the group consisting of $-SO_2R$, $-COR$ and

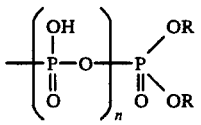

TABLE 1

| | Surface Specific resistance (Ω/□) | Surface lubricity | Blocking tendency | Transparency (haze) (%) | Printing properties: Tone | Image* density (black) | Resolution | Continuous Feed-in and feed-out properties | Adhesion to ink |
|---|---|---|---|---|---|---|---|---|---|
| Example 1 | $4.0 \times 10^{11}$ | 0.28 | ○ | 4.1 | ○ | 1.4 | ○ | ○ | ○ |
| Example 2 | $3.5 \times 10^{11}$ | 0.28 | ○ | 4.2 | ○ | 1.2 | ○ | ○ | ○ |
| Example 3 | $2.4 \times 10^{10}$ | 0.25 | ○ | 4.1 | ○ | 1.4 | ○ | ○ | ○ |
| Example 4 | $5.1 \times 10^{12}$ | 0.28 | ○ | 4.1 | ○ | 1.3 | ○ | ○ | ○ |
| Example 5 | $9.8 \times 10^{9}$ | 0.21 | ○ | 4.3 | ○ | 1.4 | ○ | ○ | ○ |
| Comp. Example 1 | $4.0 \times 10^{11}$ | 0.28 | ○ | 4.1 | x | 0.9 | x | ○ | x |
| Comp. Example 2 | $>10^{16}$ | 0.26 | ○ | 4.0 | ○ | 1.4 | ○ | x | ○ |
| Comp. Example 3 | $3.2 \times 10^{11}$ | 0.25 | ○ | 4.0 | x | 0.8 | x | ○ | x |
| Comp. Example 4 | $4.1 \times 10^{12}$ | 0.72 | x | 4.1 | ○ | 1.2 | ○ | x | ○ |

(Note) *Image density was measured with a Macbeth densitometer.

Table 2 shows the compositions of the copolyesters used in Examples.

TABLE 2

| | Copolyester | |
|---|---|---|
| | (a) | (b) |
| Dicarboxylic component (mol %) | Terephthalic acid 93% Isophthalic acid 5% Sodium sulfoisophthalic acid 2% | Terephthalic acid 50% Isophthalic acid 48% Sodium sulfoisophthalic acid 2% |
| Diol component | Ethylene glycol | Ethylene glycol |

in which R is selected from the group consisting of an alkyl group having 1 to 20 carbon atoms, an alkenyl group having 1 to 20 carbon atoms, an alkylphenyl group having 7 to 20 carbon atoms, and an amino-substituted phenyl group and n is 0 or 1, provided that a plurality of Rs in the above definition of X may be the same or different from one another, and (b) an adduct of the above compound of the formula (1) with a (meth)acrylamide in which an aminoalkyl group having 1 to 20 carbon atoms bonds to a nitrogen atom of (meth)acrylamide.

3. The thermal-transfer recording sheet of claim 2, wherein X in the formula (1) is $—SO_2R$.

4. The thermal-transfer recording sheet of claim 2, wherein X in the formula (1) is —COR.

5. The thermal-transfer recording sheet of claim 2, wherein X in the formula (1) is

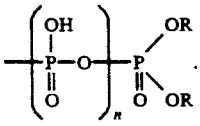

6. The thermal-transfer recording sheet of claim 1, wherein the antistatic compound (3) is a combination of (A) a compound selected from the group consisting of (a) a compound of the formula (1)

$$R^1—O—Me(O—X)_3 \quad (1)$$

wherein $R^1$ is a monovalent aliphatic hydrocarbon having 1 to 20 carbon atoms, which may be optionally interrupted by an oxygen atom, Me is Ti or Zr, and X is selected from the group consisting of $—SO_2R$, —COR and

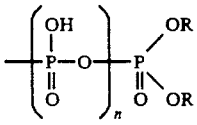

in which R is selected form the group consisting of an alkyl group having 1 to 20 carbon atoms, an alkenyl group having 1 to 20 carbon atoms, an alkylphenyl group having 7 to 20 carbon atoms, and an amino-substituted phenyl group and n is 0 or 1, provided that a plurality of Rs in the above definition of X may be the same or different from one another, and (b) an adduct of the above compound of the formula (1) with a (meth)acrylamide in which an aminoalkyl group having 1 to 20 carbon atoms bonds to a nitrogen atom of (meth)acrylamide, with (B) a compound of the formula (2)

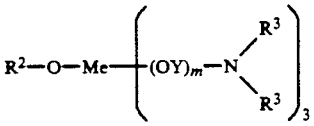

(2)

wherein $R^2$ is a monovalent aliphatic hydrocarbon having 1 to 20 carbon atoms, which may be optionally interrupted by an oxygen atom, Me is Ti or Zr, Y is an alkylene group having 2 to 4 carbon atoms, $R^3$ is a lower alkyl group having 1 to 5 carbon atoms, and m is 1 to 10, provided that the six $R^3$s in the formula may be the same or different from one another.

7. The thermal-transfer recording sheet of claim 1, wherein the composition contains, per part by weight of the copolyester (1), 0.17 to 6 parts by weight of the polyolefin fine particle filler (2) and 0.17 to 4 parts by weight of the antistatic compound (3).

8. The thermal-transfer recording sheet of claim 1, wherein the copolyester (1) comprises at least two dicarboxylic acid components and at least one diol component.

9. The thermal-transfer recording sheet of claim 1, wherein the copolyester (1) comprises at least one dicarboxylic acid component and at least two diol components.

10. The thermal-transfer recording sheet of claim 1, wherein the copolyester (1) contains a sulfonic acid group or a salt thereof.

11. The thermal-transfer recording sheet of claim 1, wherein the polyolefin fine particle filler (2) has an average particle size of 20 μm or less.

12. The thermal-transfer recording sheet of claim 1, wherein the coating as a thermal-transfer ink receiving layer has a surface tension of at least 48 dyne/$cm^2$.

13. The thermal-transfer recording sheet of claim 12, wherein the coating has a corona-treated surface.

14. The thermal-transfer recording sheet of claim 1, wherein the aromatic polyester film is a polyethylene terephthalate film.

15. The thermal-transfer recording sheet of claim 1, wherein the aromatic polyester film has a thickness of 25 to 125 μm.

16. The thermal-transfer recording sheet of claim 1, wherein the coating as a thermal-transfer ink receiving layer has, as a solid content, a weight of 0.01 to 0.5 g/$m^2$.

17. The thermal-transfer recording sheet of claim 1, wherein one surface of the aromatic polyester film has a coating as a thermal-transfer ink receiving layer and the other surface of the aromatic polyester film has a coating as a protection layer.

* * * * *